US010760582B2

(12) United States Patent
Massini et al.

(10) Patent No.: US 10,760,582 B2
(45) Date of Patent: Sep. 1, 2020

(54) STABILIZING ARRANGEMENT FOR A ROTATING VERTICAL SHAFT OF A MACHINE, MACHINE AND STABILIZING METHOD

(71) Applicant: Nuovo Pignone Srl, Florence (IT)

(72) Inventors: Andrea Massini, Florence (IT); Leonardo Tognarelli, Florence (IT); Carlo Maria Martini, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 151 days.

(21) Appl. No.: 15/535,100

(22) PCT Filed: Nov. 26, 2015

(86) PCT No.: PCT/EP2015/077719
§ 371 (c)(1),
(2) Date: Jun. 12, 2017

(87) PCT Pub. No.: WO2016/091596
PCT Pub. Date: Jun. 16, 2016

(65) Prior Publication Data

US 2017/0350406 A1 Dec. 7, 2017

(30) Foreign Application Priority Data

Dec. 12, 2014 (IT) ..... CO2014A0041

(51) Int. Cl.
*F04D 29/04* (2006.01)
*F04D 29/66* (2006.01)
(Continued)

(52) U.S. Cl.
CPC ..... *F04D 29/04* (2013.01); *F04D 27/009* (2013.01); *F04D 29/05* (2013.01); *F04D 29/10* (2013.01);
(Continued)

(58) Field of Classification Search
CPC ..... F04D 13/10; F04D 29/043; F04D 29/047; F04D 29/2266; F04D 29/0473;
(Continued)

(56) References Cited

U.S. PATENT DOCUMENTS 2,502,173 A 3/1950 Potts
3,671,137 A * 6/1972 Ball ..... F04D 29/047 384/99
(Continued)

FOREIGN PATENT DOCUMENTS

EP 3121390 A1 * 1/2017 ..... F04D 29/047

OTHER PUBLICATIONS

Corbo. M.A., et al., "Practical use of rotordynamic analysis to correct a vertical long shaft pump's whirl problem," Proceedings of the 19th International pump users symposium, Retrieved from the Internet URL: http://turbolab.tamu.edu/proc/pumpproc/P19/10.pdf, pp. 107-120 (May 10, 2002).
(Continued)

*Primary Examiner* — Kenneth J Hansen
(74) *Attorney, Agent, or Firm* — Baker Hughes Patent Org.

(57) ABSTRACT

A stabilizing arrangement for a rotating shaft including a shaft being arranged substantially vertically in a machine so as to rotate during machine operation, first pressure delivery system for delivering a fluid pressure, in particular of a fluid circulating inside the machine, at a first location of the machine. First location is close to the shaft and part of first pressure delivery system is arranged at first location so as to exert a lateral pulling or pushing action on the shaft.

9 Claims, 2 Drawing Sheets

(51) Int. Cl.
*F04D 29/10* (2006.01)
*F04D 29/05* (2006.01)
*F04D 27/00* (2006.01)

(52) U.S. Cl.
CPC ..... *F04D 29/66* (2013.01); *F04D 29/661* (2013.01); *F04D 29/668* (2013.01); *F04D 29/669* (2013.01)

(58) Field of Classification Search
CPC ..... F04D 29/04; F04D 29/10; F04D 29/661; F05B 2240/53; F16C 32/064; F16C 32/06; F16C 39/04
See application file for complete search history.

(56) References Cited

U.S. PATENT DOCUMENTS 5,529,464 A * 6/1996 Emerson ..... F04D 1/06 384/106
2002/0153789 A1 10/2002 Knox et al.
2006/0196655 A1* 9/2006 Wang ..... E21B 43/128 166/105.3
2009/0311089 A1* 12/2009 Begin ..... F03B 11/06 415/104
2012/0251362 A1 10/2012 Forsberg

OTHER PUBLICATIONS

Italian Search Report and Written Opinion issued in connection with corresponding IT Application No. ITCO2014A000041 dated Aug. 31, 2015.
International Search Report and Written Opinion issued in connection with corresponding PCT Application No. PCT/EP2015/077719 dated Jan. 26, 2016.
International Preliminary Report on Patentability issued in connection with corresponding PCT Application No. PCT/EP2015/077719 dated Jun. 13, 2017.
Machine translation and First Office Action and Search issued in connection with corresponding CN Application No. 201580067634.1 dated Aug. 1, 2018.

* cited by examiner

STABILIZING ARRANGEMENT FOR A ROTATING VERTICAL SHAFT OF A MACHINE, MACHINE AND STABILIZING METHOD

BACKGROUND

Embodiments of the subject matter disclosed herein correspond to stabilizing arrangements for a rotating vertical shaft, machines with a stabilizing arrangement and stabilizing methods.

In particular, the machines concerned are those commonly used in the field of "Oil & Gas", mainly subsea single phase or multi phase pumps or compressors; sea water injection is also a possible application of the present invention.

Rotating vertical shafts of machines, especially when shafts are long, are typically subject to radial movements (for example random vibrations) due to lateral asymmetrical actions.

In the field of "Oil & Gas", vertical shafts are used in turbomachines, such as subsea pumps and compressors, and are typically maintained in position by plain cylindrical or tilting-pad journal bearings. These machines tend to suffer from instability phenomena due to inherent lightly-loaded condition and the vertical orientation of their shafts inside the bearings. Such instability phenomena cause radial vibrations and may lead to damages to the rotor and even its failure.

From the article "Practical use of rotordynamic analysis to correct a vertical long shaft pump's whirl problem" by Mark A. Corbo and Robert A. Leishear in "Proceedings of the 19th International pump users symposium" pages 107-120, "tilting-pad bearings" with a geometric preload are used on a rotating long vertical shaft of a pump to solve the problem of high level of vibrations and "rotordynamic instability". According to the known operation of "tilting-pad bearings", one or more of the pads slightly rotate about a vertical axis and thus the rotating shaft remains substantially vertical.

Tilting-pad bearings do not really solve the problem of the instability phenomena due to lightly-loaded and vertical shafts.

Use of bearings eccentrically mounted about the vertical shaft is also known in order to generate a radial load to solve such instability problem.

SUMMARY

In the field of "Oil & Gas", there is a general need for improved solutions to the problem of stability of rotating vertical shafts, in particular the long ones; typically, such shafts suffer from instability due to lightly-loaded and vertical shafts.

An important idea is to apply at least a lateral loading or action to the rotating shaft of the machine. In particular, this is obtained through a pulling or pushing pressure acting on the rotating shaft. In particular, this is generated directly or indirectly by a fluid under pressure in the machine, in particular a working fluid of the machine.

Embodiments of the subject matter disclosed herein relate to a stabilizing arrangement for a rotating shaft.

Such arrangement comprises: a shaft being arranged substantially vertically in a machine so as to rotate during machine operation; first pressure delivery system for delivering a fluid pressure, in particular of a fluid circulating inside the machine, at a first location of the machine; said first location is close to the shaft and part of said first pressure delivery system is arranged at said first location so as to exert a lateral pulling or pushing action on the shaft.

Embodiments of the subject matter disclosed herein relate to a machine with a stabilizing arrangement for at least one of its rotating shafts.

Embodiments of the subject matter disclosed herein relate to a method for stabilizing a rotating shaft of a machine.

According to such method, the rotating shaft of the machine is arranged substantially vertically, and a lateral pulling or pushing action is applied to the rotating shaft at least at a first position close to the shaft.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

Figure 1:
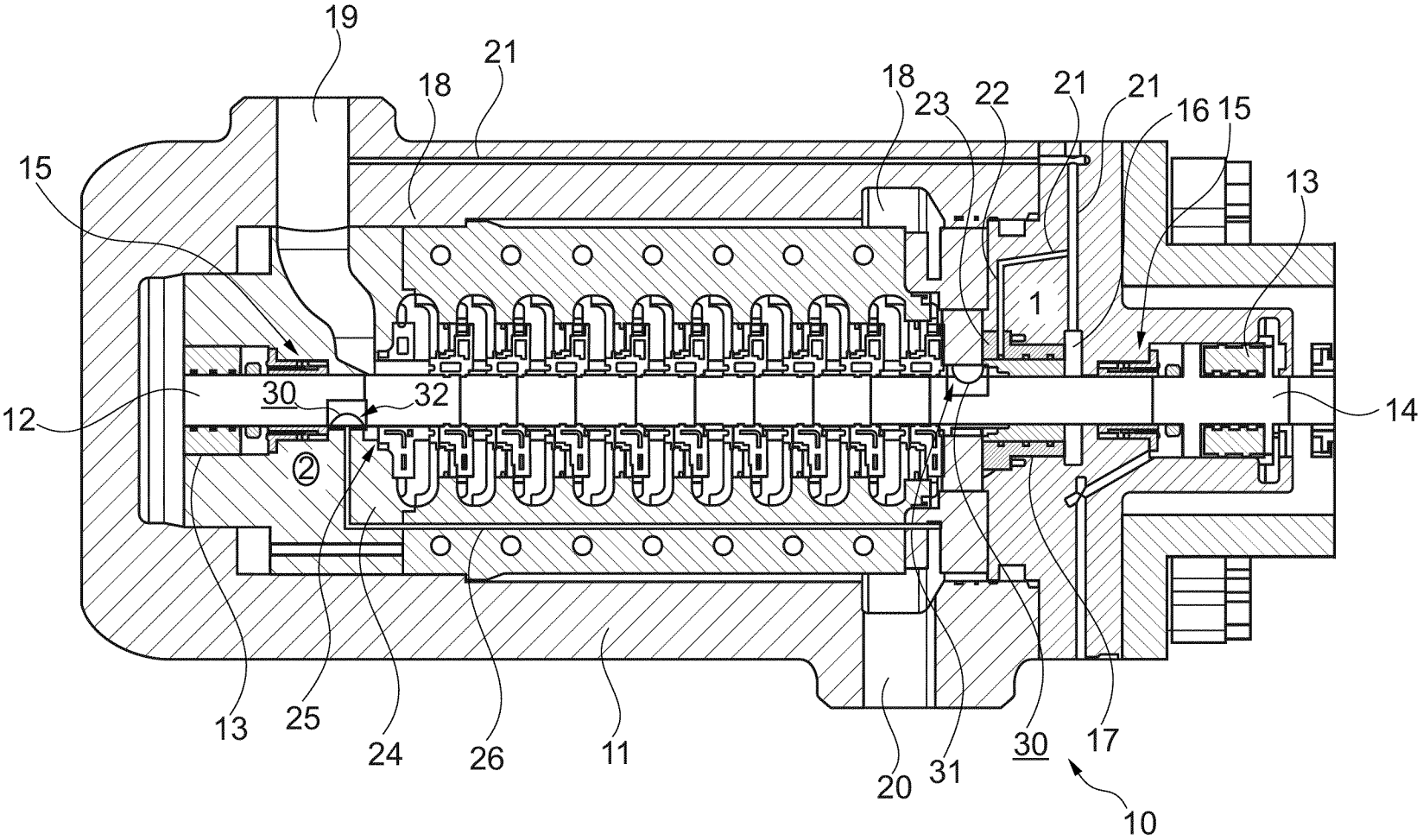
FIG. 1 shows a longitudinal cross-section of an embodiment of a machine comprising a stabilizing arrangement.

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

One embodiment of a machine comprising the stabilizing arrangement will be described in the following with reference to FIG. 1, FIG. 2, FIG. 3 and FIG. 4

The showed machine, indicated as 10 in its whole, is a centrifugal pump, in particular a subsea pump for processing oil or natural gas or sea water. It comprises a stabilizing arrangement for a rotating shaft 12, which comprises: a shaft 12, which is arranged vertical inside the machine 10 so as to rotate during machine operation, first pressure delivery system for delivering a fluid pressure of a fluid circulating inside the machine 10 at a first location 1 of the machine 10, the first location 1 being close to the shaft 12, second pressure delivery system for delivering a fluid pressure of a fluid circulating inside the machine 10 at a second location 2 of the machine 10, the second location 2 being close to the shaft 12.

The shaft 12 is arranged inside a pump case 11 of the pump 10 by means of two journal bearings 13 located next to ends of the shaft 12, the upper one being located between a coupling 14, to be fastened to a motor unit, for rotating the shaft 12, and a mechanical seal 15. Down the seal 15, a balancing chamber 16 and a balancing drum 17 follow along the shaft 12, just up a pump body 18 in the pump case 11. The pump case 11 is provided with a pump suction flange 19, wherein a suction pressure is present during the pump operation, and a pump discharge flange 20, where a discharge pressure is present during pump operation. Down to the pump body 18, second mechanical seal 15 and second journal bearing 13 are provided at the shaft 12 lower end.

The first pressure delivery system comprises: a first line 21 (corresponding to a balancing line that may be considered a first bleeding means), which connects the suction flange 19 to the balancing chamber 16, and which is connected to a first pressure conduit 22, a first pressure delivery opening 23 provided at a final end of the first pressure conduit 22, the opening 23 being located at the first location 1 close to the shaft 12; a first sealing device 30, close to the shaft 12 at the first location 1, surrounding the delivery opening 23 and arranged so as to convey a fluid first pressure to the shaft 12 through a first area 31 (see FIG. 4) on which the first pressure is exerted.

The second pressure delivery system comprises: a first line 26 (that may be considered a second bleeding means), which connects the discharge flange 20 to a second pressure conduit 24, a second pressure delivery opening 25 provided at a final end of the second pressure conduit 24, the opening 24 being located at the second location 2 close to the shaft 12; a second sealing device 30, close to the shaft 12 at the second location 2, surrounding the delivery opening 25 and arranged so as to convey a fluid second pressure to the shaft 12 through a first area 32 on which the second pressure is exerted.

From the above, it is apparent that the first and the second pressure delivery systems comprise bleeding systems 21 and 26 of a working fluid of the machine 10, the bleeding systems being in fluid connection to the pressure delivery openings 23, 25. Between them, pressure conduits 22, 24 are realized out for example by simply drilling bodies 11 and 18 of the machine 10. So the stabilizing arrangement comprising such bleeding systems is simple and cheap to be arranged and carried out.

The following is the operation of the above described stabilizing arrangement when the pump 10 is operated, for instance by means of a motor shaft which is coupled to the coupling 14.

A first pressure of a fluid operated in the pump 10, which is a suction pressure, is delivered via the above described first pressure delivery system working as bleeding means, which are the balancing line 21, the derived first pressure conduit 22 and the first pressure delivery opening 23, to the first area 31 facing to a lateral portion of the shaft 12 at the first location 1. By defining the surface extension of the first area 31 surrounded by the sealing device 30, is possible do precisely determine the lateral pulling load acting on the shaft 12 at the first location 1 in order to stabilize the same shaft 12.

A second pressure of the fluid operated, which is a discharge pressure, is delivered via the above described second pressure delivery system working as bleeding means, which are the second pressure conduit 24 and the second pressure delivery opening 25, to the second area 32 facing to a lateral portion of the shaft 12 at the second location 2. By the means of defining the surface extension of the second area 32 surrounded by the sealing device 30, is possible do precisely determine the lateral pushing load acting on the shaft 12 at the second location 2 in order to stabilize the same shaft 12.

It follows that the stabilizing arrangement disclosed herein allows to determine the precise needed lateral loading at certain locations on the shaft, so granting to fully stabilize the same shaft.

Figure 4:
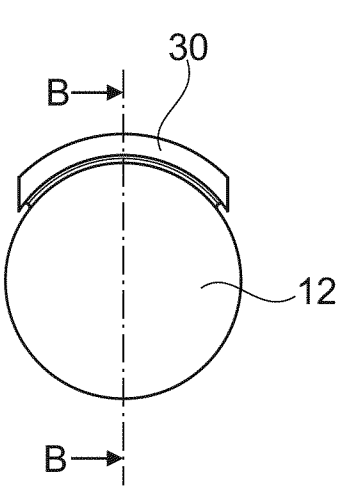
FIG. 4 shows two cross-section views, according to lines A-A and B-B in FIG. 3, of the detail of FIG. 2.
Figure 4:
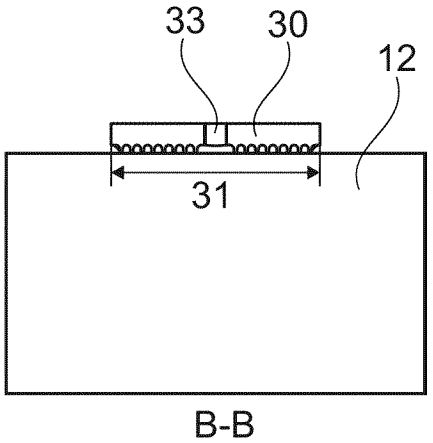
Figure 3:
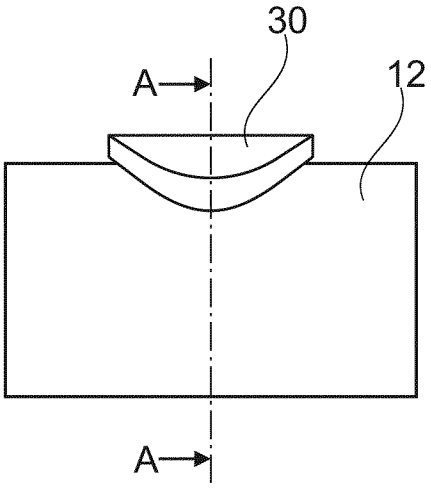
FIG. 3 shows a front and a lateral view of the detail of FIG. 2 in a working position.
Figure 3:
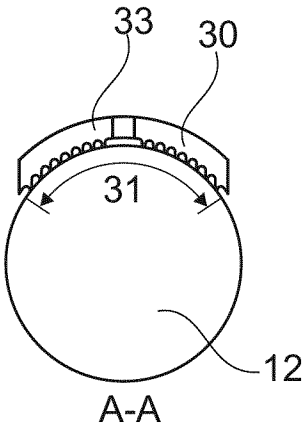
Figure 2:
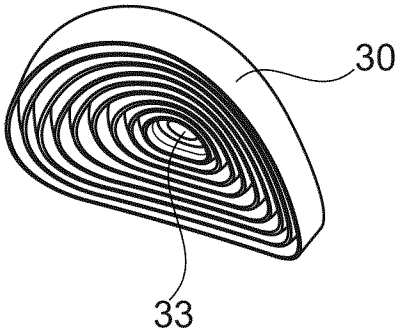
FIG. 2 shows perspective views of a detail of the embodiment of FIG. 1, specifically a sealing device.
Figure 2:
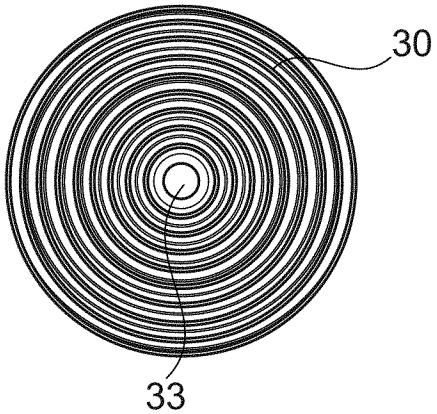

In FIG. 2, FIG. 3 and FIG. 4 the sealing device 30 is of a labyrinth type. It comprises a pad 30 with a lower concentric labyrinth type seal configured with an empty central portion 33 having e.g. the lower area 31 defined by means of an external lip of the labyrinth tread of the seal. This kind of sealing device allows a perfect adherence to the shaft 12 with an optimum sealing to the fluid pressure as conveyed through the central portion 33 to the area 31. As said before, the possibility of varying surfaces extensions of the area 31 allows a perfect calibration of local loading to be exerted on the shaft 12, so fully stabilizing the same.

In other embodiments, the sealing device may be of a honeycomb type or of a abradable type.

Moreover, first location 1 and second location 2 inside the machine 10 and close to the shaft 12 are remote from each other, in particular being substantially located next to opposite ends of the shaft 12. This displacement allows a better and wide possibility of exerting an efficient lateral loading onto the shaft in order to fully stabilize it. Furthermore, through such arrangement of parts, it is easier and simpler to configure the pressure delivery system and concerned bleeding means (e.g. system or systems).

According to the above description, an embodiment of the subject matter disclosed herein relates to a method for stabilizing a rotating shaft 12 of a machine, the shaft being substantially arranged vertical. It provides a lateral loading which is applied to the rotating shaft 12 at least at a first position 1 close to the shaft 12.

Moreover, lateral loading is applied to the rotating shaft 12 at a first position 1 and at a second position 2, in particular said first position 1 and second position 2 being remote from each other.

The working fluid is bled from one or more points, the first and second pressure delivery openings 23, 25 being at different fluid pressures inside the machine 10, more in detail at the pump suction and discharge or delivery pressure.

In another embodiment, each lateral loading of the shaft is due to one or more pulling or pushing pressures of a working fluid acting on the rotating shaft.

In one embodiment, the lateral loading may be generated by one or more working fluids under pressure, where the fluids may be delivered from working fluids inside or outside the machine.

Another embodiment of a stabilizing arrangement may comprise first and/or second pressure delivery system or systems which are fixed to or integrated in a journal bearing of the machine in order to fit the final configuration of the machine in a more practical way.

In another embodiment of a stabilizing arrangement, first and/or second pressure delivery system or systems are fixed to or integrated in a balancing drum of the machine in order to simplify the final configuration of the machine.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A stabilizing arrangement comprising:

a rotatable shaft arranged substantially vertically in a machine so as to rotate during machine operation;

a first pressure delivery system for delivering a first fluid pressure at a first location proximate the rotatable shaft;

a second pressure delivery system for delivering a second fluid pressure at a second location proximate the shaft, wherein the second location is axially spaced from the first location relative to the rotational axis of the rotatable shaft;

at least a first pressure delivery opening located at the first location;

a first sealing device surrounding the at least first pressure delivery opening and adhering to a first surface area of the rotatable shaft;

at least a second pressure delivery opening located at the second location; and a second sealing device surrounding the at least a second pressure delivery opening and adhering to a second surface area of the rotatable shaft, wherein the first and the second pressure delivery systems each comprise a bleeding system of a working fluid of the machine, one bleeding system connected to a suction flange of the machine to generate the first fluid pressure and the other bleeding system connected to a discharge flange of the machine to generate the second fluid pressure, the first and second fluid pressures acting on the shaft to stabilize the shaft when rotating.

2. The arrangement of claim 1, wherein the first and the second sealing devices are labyrinth seals.

3. The arrangement according to claim 1, wherein the first pressure delivery system delivers the fluid pressure of a fluid circulating inside the machine.

4. The arrangement according to claim 3, wherein the second pressure delivery system delivers the fluid pressure of a fluid circulating inside the machine at a second location of the machine.

5. The arrangement according to claim 1, wherein the first location and the second location are at substantially opposite ends of the rotatable shaft.

6. A machine, comprising a stabilizing arrangement for a rotatable shaft comprising:

a rotatable shaft arranged substantially vertically in the machine so as to rotate during machine operation;

a first pressure delivery system for delivering a first fluid pressure at a first location proximate the rotatable shaft;

a second pressure delivery system for delivering a second fluid pressure at a second location proximate the shaft, wherein the second location is axially spaced from the first location relative to the rotational axis of the rotatable shaft;

at least a first pressure delivery opening located proximate to the first location;

a first sealing device surrounding the at least first pressure delivery opening and adhering to a first surface area of the rotatable shaft;

at least a second pressure delivery opening located proximate to the second location;

a second sealing device surrounding the at least a second pressure delivery opening and adhering to a second surface area of the rotatable shaft, wherein the first and the second pressure delivery systems each comprise a bleeding system of a working fluid of the machine, one bleeding system connected to a suction flange of the machine to generate the first fluid pressure and the other bleeding system connected to a discharge flange of the machine to generate the second fluid pressure, the first and second fluid pressures acting on the shaft to stabilize the shaft when rotating.

7. The machine of claim 6, further comprising a single or multi phase pump or a compressor.

8. The machine of claim 6, wherein the machine processes oil or natural gas or sea water.

9. The machine of claim 7, wherein the single or multi phase pump or a compressor is for subsea applications.

* * * * *